US011661777B2

(12) United States Patent
Balekundri

(10) Patent No.: US 11,661,777 B2
(45) **Date of Patent: *May 30, 2023**

(54) APPLIANCE DOOR HINGE ASSEMBLY

(71) Applicant: WHIRLPOOL CORPORATION, Benton Harbor, MI (US)

(72) Inventor: Abubackar M. Balekundri, Belgaum (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/589,260

(22) Filed: Jan. 31, 2022

(65) Prior Publication Data

US 2022/0186538 A1 Jun. 16, 2022

Related U.S. Application Data

(63) Continuation of application No. 17/117,442, filed on Dec. 10, 2020, now Pat. No. 11,236,536.

(51) Int. Cl.
*E05D 11/10* (2006.01)
*E05D 7/081* (2006.01)
(Continued)

(52) U.S. Cl.
CPC ..... *E05D 11/1028* (2013.01); *E05D 7/081* (2013.01); *E05D 7/1005* (2013.01);
(Continued)

(58) Field of Classification Search
CPC ..... E05D 11/1028; E05D 2011/1035; E05D 11/06; E05D 11/1078; E05D 11/1042;
(Continued)

(56) References Cited

U.S. PATENT DOCUMENTS 48,264 A * 6/1865 Drum ..... E05D 7/081 16/317
208,152 A * 9/1878 Clark ..... E05D 7/081 16/317
(Continued)

FOREIGN PATENT DOCUMENTS

DE 202004003997 U1 7/2004
EP 0777027 B1 7/2001
(Continued)

*Primary Examiner* — Jeffrey O'Brien
(74) *Attorney, Agent, or Firm* — Price Heneveld LLP

(57) ABSTRACT

An appliance includes a door with a plurality of panels spaced apart by a vertical support. A lower hinge mount is coupled with an appliance body. A first pivot member is coupled with the lower hinge mount and includes a first protrusion. A lower hinge support is fixedly coupled with the vertical support and includes an elongate coupling plate and a hinge arm that extends orthogonal relative to a longitudinal extent of the elongate coupling plate. A stop extends from the hinge arm. A second pivot member has a receiving space that receives the stop. The second pivot member includes a second protrusion that is in abutting contact with the first protrusion. A lower hinge pin extends through the lower hinge support and the second pivot member. The lower hinge pin is vertically translated when the second pivot member moves from a first position to a second position.

18 Claims, 15 Drawing Sheets

(51) Int. Cl.
*E05D 7/10* (2006.01)
*E05D 11/06* (2006.01)
*E05D 7/04* (2006.01)

(52) U.S. Cl.
CPC ..... *E05D 11/06* (2013.01); *E05D 2007/0469* (2013.01); *E05D 2007/1027* (2013.01); *E05D 2011/1035* (2013.01); *E05Y 2201/638* (2013.01); *E05Y 2900/30* (2013.01)

(58) Field of Classification Search
CPC ..... E05D 7/08; E05D 7/081; E05D 7/1005; F25D 2323/024; F24B 13/004; E05Y 2900/31; E05Y 2900/308; E05F 1/063; B65D 25/2873
See application file for complete search history.

(56) References Cited

U.S. PATENT DOCUMENTS 606,415 A * 6/1898 Hotaling ..... E05D 11/00 16/351
753,443 A * 3/1904 Hilaire ..... E05D 3/12 16/350
2,619,673 A * 12/1952 Evans ..... E05D 11/1014 16/386
3,113,649 A * 12/1963 Wargo ..... E05F 1/063 16/312
3,131,422 A * 5/1964 Agius ..... E05D 7/081 16/392
3,378,881 A * 4/1968 Hentzi ..... E05D 7/081 16/312
3,398,487 A * 8/1968 Matyas ..... E06B 3/72 16/312
3,628,845 A * 12/1971 Grimm ..... E05F 1/063 16/312
3,722,031 A * 3/1973 Bourgeois ..... E05F 1/063 16/317
4,090,274 A * 5/1978 Bourgeois ..... E05F 1/063 16/317
5,369,842 A * 12/1994 Beatty ..... E05D 7/081 16/317
5,788,351 A 8/1998 Prunty et al.
6,561,180 B1 5/2003 Austin et al.
6,845,545 B2 * 1/2005 Han ..... F25D 23/028 312/319.2
7,111,363 B2 * 9/2006 Lee ..... E05D 7/081 16/334
7,509,709 B2 * 3/2009 Chung ..... G06F 1/1616 16/319
7,536,749 B2 * 5/2009 Lu ..... G06F 1/1681 16/340
8,510,913 B2 * 8/2013 Kim ..... E05D 11/1028 16/334
8,544,151 B2 * 10/2013 Courbon ..... E05D 11/1078 16/334
8,721,013 B2 * 5/2014 Gore ..... F25D 23/00 312/401
9,115,903 B2 8/2015 Lim et al.
9,372,001 B2 6/2016 Gayle et al.
9,395,089 B2 7/2016 Nelson et al.
9,739,523 B1 * 8/2017 Augsburger ..... E05D 3/02
9,790,722 B2 * 10/2017 Sun ..... E05D 7/0027
9,834,967 B2 * 12/2017 Johnson ..... E05D 7/081
9,903,638 B2 * 2/2018 Dubina ..... E05D 7/02
10,060,168 B2 * 8/2018 Corpuz, Jr. ..... E05D 7/081
10,407,958 B1 * 9/2019 Tsou ..... E05D 3/02
10,458,164 B2 * 10/2019 Wantland ..... E05F 1/043
11,015,377 B2 * 5/2021 Jager ..... E05D 7/04
11,060,333 B2 * 7/2021 Manara ..... E05D 11/105
2005/0194875 A1 * 9/2005 Reed ..... E05D 7/081 312/405.1
2009/0179539 A1 * 7/2009 Henriksson ..... E05F 5/06 312/405
2010/0218342 A1 * 9/2010 Bertolini ..... E05F 1/063 16/244
2011/0099757 A1 * 5/2011 Chang ..... G06F 1/1681 16/297
2013/0076222 A1 * 3/2013 Lee ..... F25D 23/028 16/248
2013/0154464 A1 * 6/2013 Fiori ..... F25D 23/028 16/303
2015/0121655 A1 * 5/2015 Lee ..... E05D 7/00 16/312
2015/0345203 A1 * 12/2015 Vanini ..... E05F 3/14 16/68
2019/0040666 A1 2/2019 Park et al.
2020/0308887 A1 * 10/2020 Raab ..... F25D 23/028
2020/0408420 A1 * 12/2020 Manara ..... E05D 5/06
2021/0262672 A1 * 8/2021 Crawford ..... E05D 7/081

FOREIGN PATENT DOCUMENTS

FR 2575512 B3 7/1987
GB 2410059 B 8/2006
KR 20170127605 A 7/2004
KR 20080082848 A 9/2008

* cited by examiner

APPLIANCE DOOR HINGE ASSEMBLY

CROSS-REFERENCE TO RELATED APPLICATION

This application is a continuation of U.S. patent application Ser. No. 17/117,442, filed on Dec. 10, 2020, now U.S. Pat. No. 11,236,536, entitled "APPLIANCE DOOR HINGE ASSEMBLY," the disclosure of which is hereby incorporated herein by reference in its entirety.

FIELD OF DISCLOSURE

The present disclosure generally relates to a hinge assembly for an appliance door, and more specifically, to a self-retaining hinge assembly for an appliance door.

BACKGROUND

Hinge assemblies are used on appliances to rotatably couple doors with cabinets. In various situations, the door may include a mechanism for retaining the door in an open position.

SUMMARY OF THE DISCLOSURE

According to one aspect of the present disclosure, an appliance includes a door with a plurality of panels spaced apart by a vertical support. A lower hinge mount is coupled with an appliance body. A first pivot member is coupled with the lower hinge mount and includes a first protrusion. A lower hinge support is fixedly coupled with the vertical support and includes an elongate coupling plate and a hinge arm that extends orthogonal relative to a longitudinal extent of the elongate coupling plate. A stop extends from the hinge arm. A second pivot member has a receiving space that receives the stop. The second pivot member includes a second protrusion that is in abutting contact with the first protrusion. A lower hinge pin extends through the lower hinge support and the second pivot member. The lower hinge pin is vertically translated when the second pivot member moves from a first position to a second position.

According to another aspect of the present disclosure, an appliance includes a lower hinge mount coupled with an appliance body and a door. A first pivot member is coupled with the lower hinge mount and defines a first pin receptacle. The first pivot member includes a first protrusion that has a first inclined surface. A second pivot member defines a second pin receptacle that is aligned with the first pin receptacle and includes a second protrusion that has a second inclined surface. The second pivot member is rotatable relative to the first pivot member between first and second positions. The second inclined surface contacts the first inclined surface in the second position. A lower hinge pin is coupled with the second pivot member to rotate with the second pivot member. The lower hinge pin is vertically translated through the first pin receptacle when the second pivot member moves from the first position to the second position. A lower hinge support is coupled with the door and defines a support pin receptacle that is aligned with the first and second pin receptacles. The lower hinge support further includes a stop that extends toward the second pivot member and the second pivot member defines a receiving space that receives the stop.

According to yet another aspect of the present disclosure, a lower hinge assembly for an appliance door includes a lower pivot member that is coupled with a hinge mount and defines a first pin receptacle. The lower pivot member includes a lower protrusion. An upper pivot member defines a second pin receptacle that is aligned with the first pin receptacle and includes an upper protrusion. A lower hinge pin extends through the first and second pin receptacles and is coupled to rotate in conjunction with the upper pivot member. The lower hinge pin is vertically translated within the first pin receptacle when the upper pivot member moves from a first position to a second position. A lower hinge support includes a stop monolithic with the lower hinge support. The stop extends toward the upper pivot member and the stop is received within a receiving space that is defined by the upper pivot member to non-rotatably couple the upper pivot member with the lower hinge support.

These and other features, advantages, and objects of the present disclosure will be further understood and appreciated by those skilled in the art by reference to the following specification, claims, and appended drawings.

Figure 1:
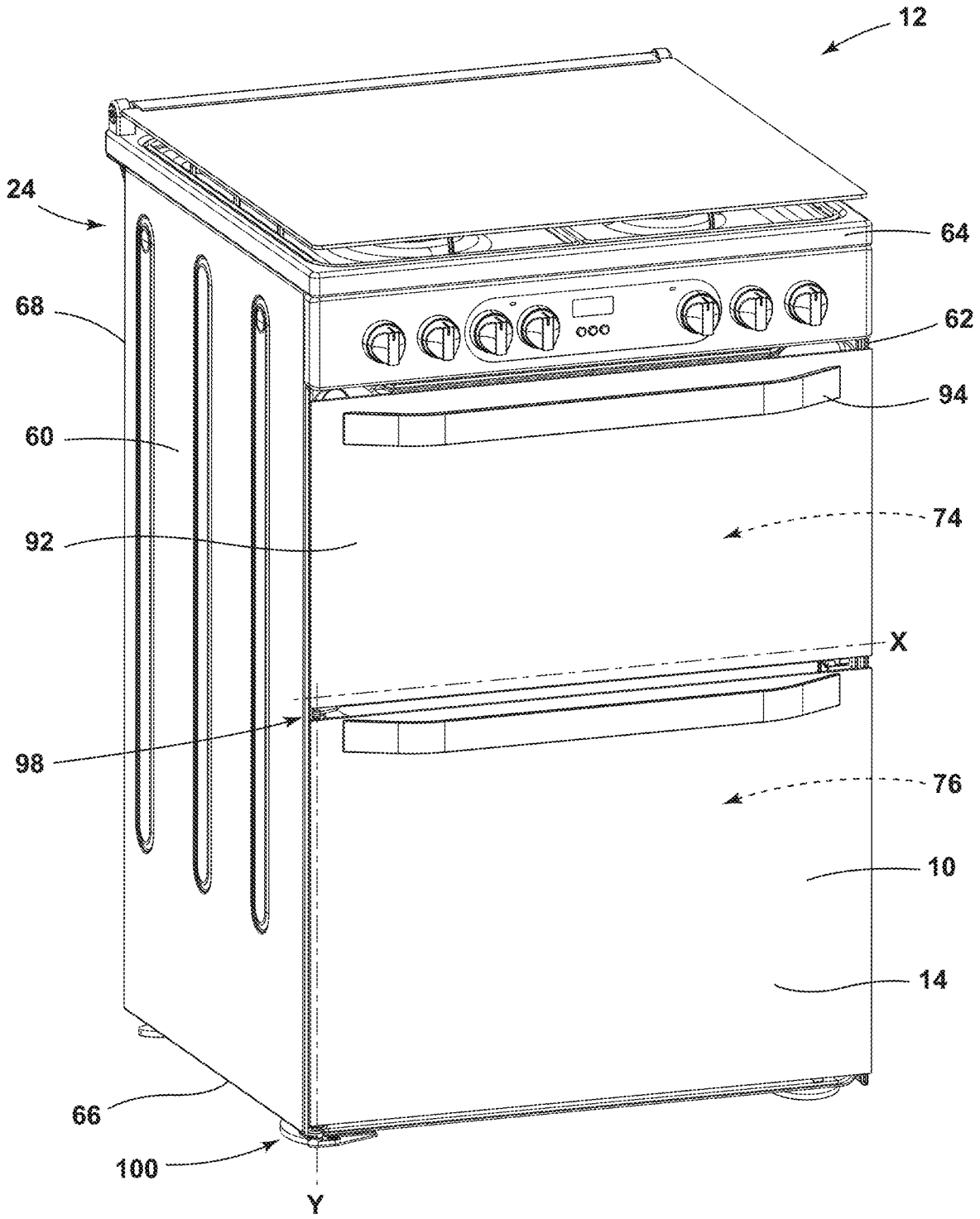
FIG. 1 is a side perspective view of an oven appliance including top and bottom doors, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a hinge assembly for an appliance door. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-14, reference numeral 10 generally designates door, referred to also as the bottom door 10 of the exemplary appliance 12 illustrated herein. The bottom door 10 includes a plurality of panels 14, 16 coupled with and spaced apart by one of first and second vertical supports 18, 20. A lower hinge mount 22 is coupled with an appliance body 24. A first pivot member 26 is coupled with the lower hinge mount 22 and includes a first protrusion 28*a*, 28*b*. The first protrusion 28*a*, 28*b* includes an inclined surface 30*a*-30*d* and a horizontal surface 32*a*, 32*b* and extends at least partially about a circumference of a first pin receptacle 34 defined by the first pivot member 26. A lower hinge support 36 is fixedly coupled with the vertical support 18, 20. A second pivot member 38 is coupled with the lower hinge support 36. The lower hinge support 36 is rotatable relative to the first pivot member 26 between a first position (FIG. 11) and a second position (FIG. 14). The second pivot member 38 includes a second protrusion 40*a*, 40*b* having an inclined surface 42*a*-42*d* and a horizontal surface 44*a*, 44*b*. The second protrusion 40*a*, 40*b* extends at least partially about a circumference of a second pin receptacle 46 defined by the second pivot member 38. The horizontal surface 44*a*, 44*b* of the second protrusion 40*a*, 40*b* contacts the horizontal surface 32*a*, 32*b* of the first protrusion 28*a*, 28*b* when the lower hinge support 36 is in the first position, and the inclined surface 42*a*-42*d* of the second protrusion 40*a*, 40*b* contacts the inclined surface 30*a*-30*d* of the first protrusion 28*a*, 28*b* in the second position. A lower hinge pin 48 extends through the first and second pin receptacles 34, 46. The lower hinge pin 48 is fixedly coupled with the lower hinge support 36 and is vertically translated within the first and second pin receptacles 34, 46 as the second pivot member 38 moves from the first position to the second position.

Figure 2:
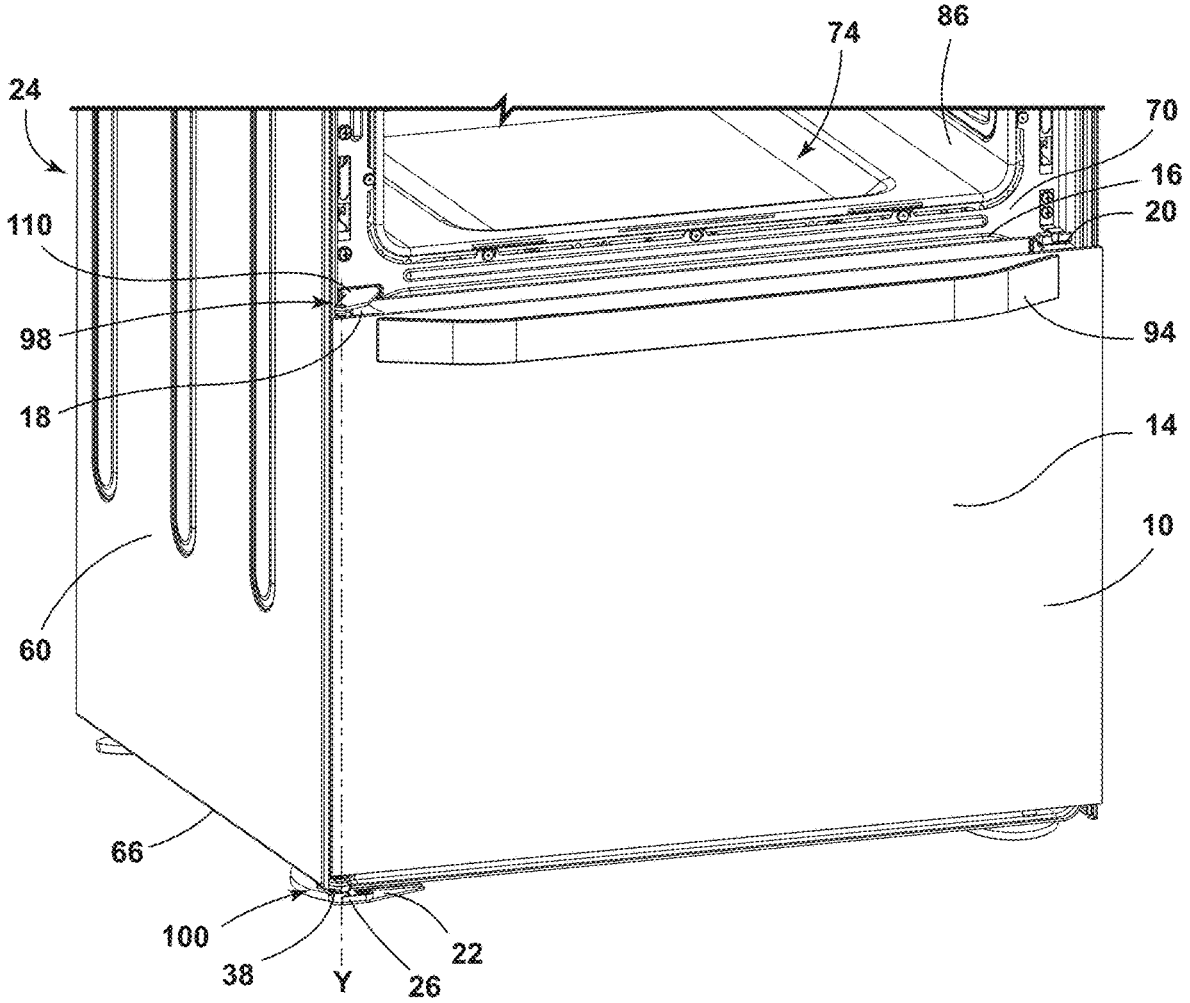
FIG. 2 is a partial side perspective view of the oven appliance of FIG. 1 with the top door removed.

Referring now to FIGS. 1 and 2, the appliance 12 is illustrated including the appliance body 24 defining a top cavity 74 and a bottom cavity 76. The appliance body 24 includes first and second side panels 60, 62, a top panel 64, a bottom panel 66, and a rear panel 68, and a front panel 70. In various examples, the top cavity 74 and the bottom cavity 76 may be defined by liners 86, 88 positioned within the appliance body 24. It will be understood that the appliance body 24 encloses components typically found in a conventional cooking oven, such as electrical components, heating elements, gas lines, valves, control units, burner elements, broiled elements, and the like. Such components will not be described further herein except where necessary for a complete understanding of the aspects of the present disclosure.

As illustrated in FIG. 1, a top door 92 is positioned to selectively seal the top cavity 74, and the bottom door 10 is positioned to selectively seal the bottom cavity 76. Each of the doors 10, 92 is hingedly coupled with the appliance body 24 and movable between an open position and a closed position. Handles 94 may be coupled to each of the doors 10, 92 to facilitate rotation of the respective door 10, 92 between the open and closed positions. The top door 92 is rotatable about a horizontal axis X between the open and closed positions.

The bottom door 10 is positioned below the top door 92 and is hingedly coupled with the appliance by upper and lower hinge assemblies 98, 100. The bottom door 10 is configured to be rotated about a vertical axis Y extending through the upper hinge assembly 98 and the lower hinge assembly 100 of the bottom door 10. The remainder of the disclosure is directed to the bottom door 10, the upper and lower hinge assemblies 98, 100 coupling the bottom door 10 with the appliance body 24, and the features directly relevant to these components. It will be understood that, while the top door 92 is illustrated with a different configuration, the top door 92 may be modified such that the same features described with respect to the bottom cavity 76 and the bottom door 10 may be applied to both the top and bottom doors 10, 92 without departing from the scope of the present disclosure.

Figure 3:
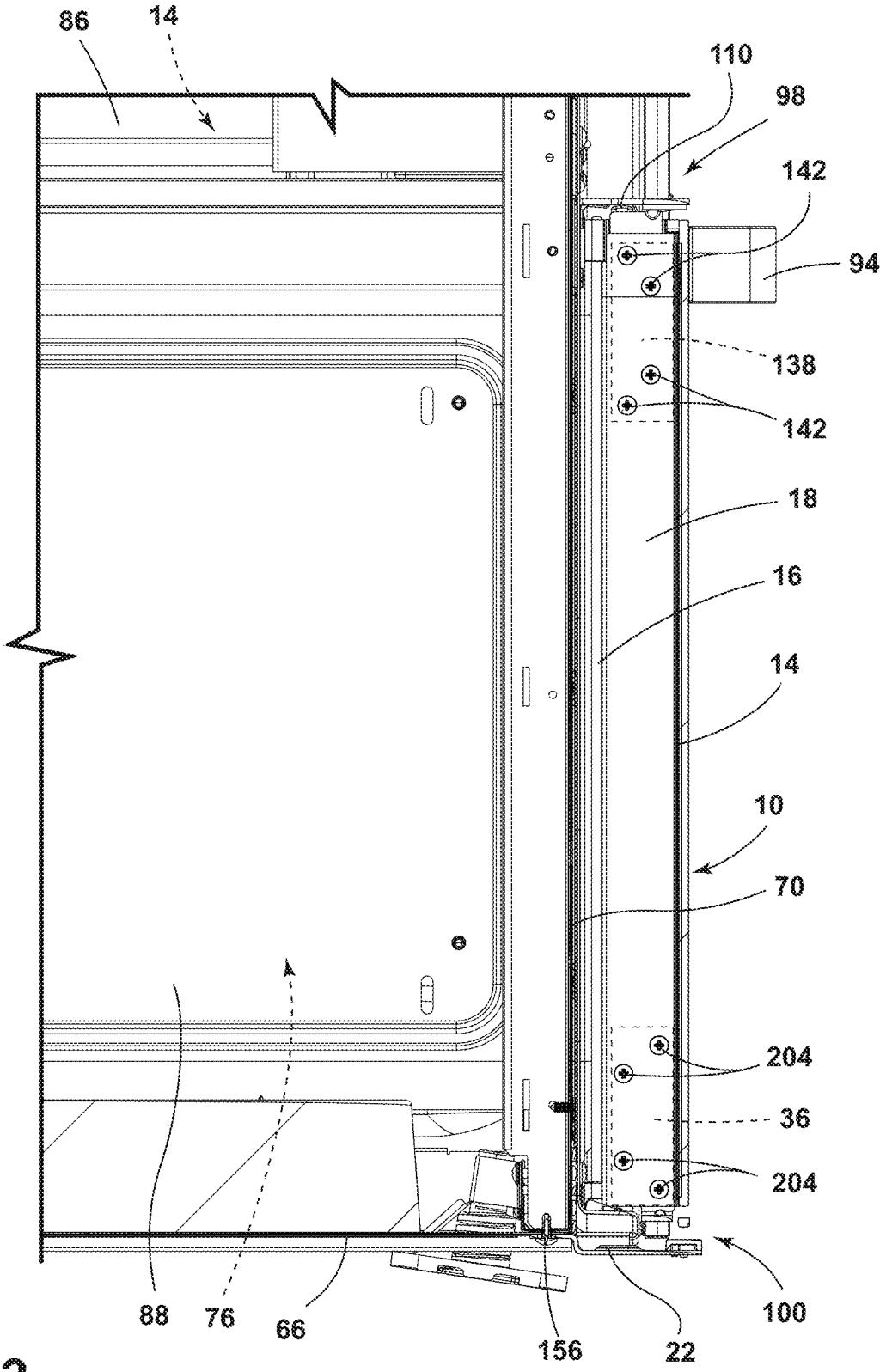
FIG. 3 is a partial side profile view of the oven appliance of FIG. 2 with an outer side panel removed.

Referring to FIGS. 2 and 3, the bottom door 10 includes a plurality of door panels 14, 16 including at least an outer door panel 14 and an inner door panel 16. The door panels 14, 16 are coupled with a pair of vertical supports 18, 20 positioned on opposing sides of the door 10. The pair of vertical supports 18, 20 are configured to space apart the outer and inner door panels 14, 16. It will be understood that any number of panels, including intermediate panels, may be coupled with the vertical support(s) 18, 20, depending on the configuration of the door 10. It is also contemplated that one or all of the panels, including one or both of the outer and inner door panels 14, 16 may be configured as glass panels. The vertical support 18 positioned proximate the hinge axis Y of the door 10 is configured to be coupled with the upper and lower hinge assemblies 98, 100 of the bottom door 10 to hingedly couple the door 10 with the appliance 12, as described in more detail elsewhere herein.

Figure 4:
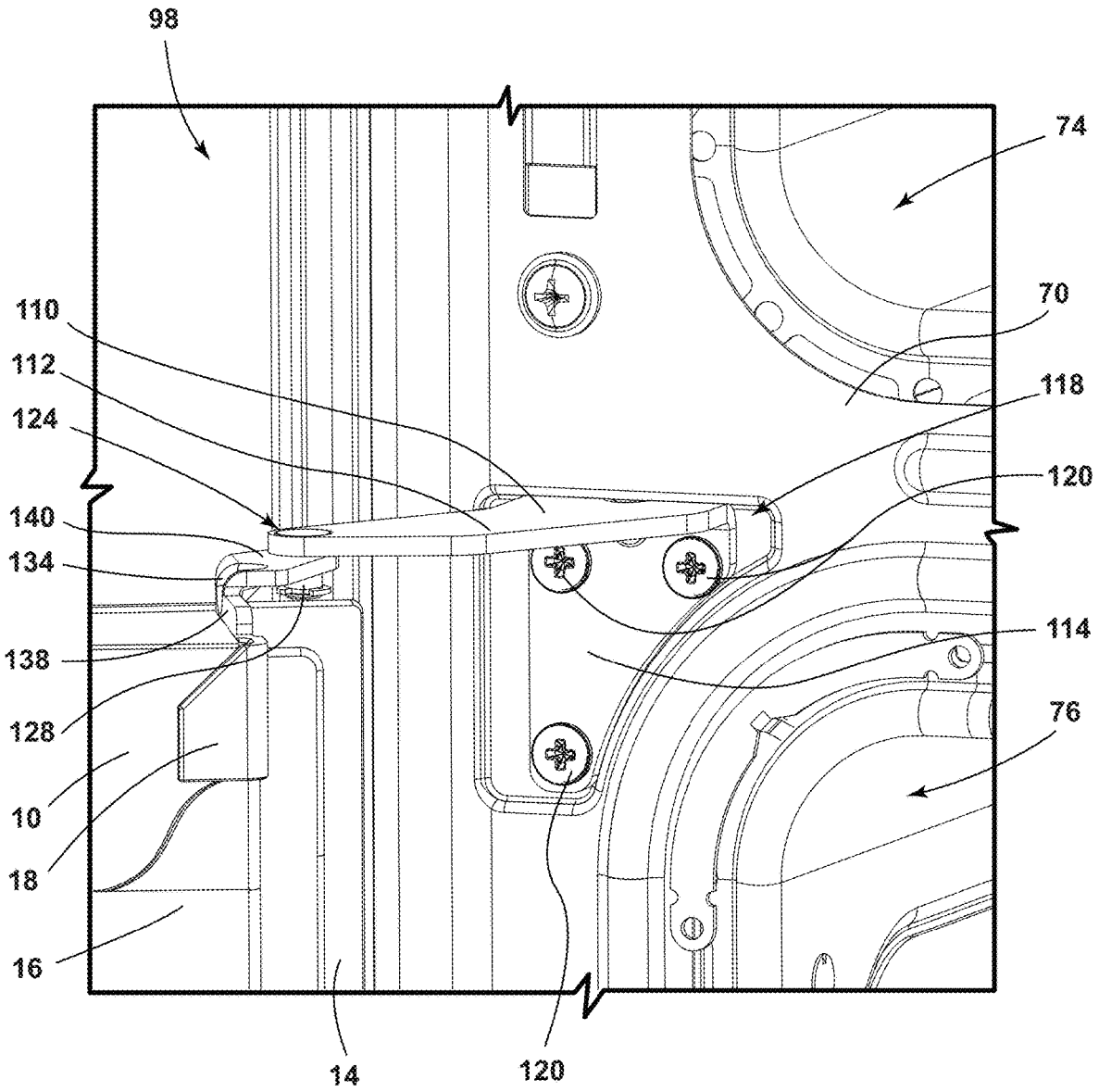
FIG. 4 is a partial front perspective view of the oven appliance of FIG. 1 illustrating an upper hinge assembly of the bottom door when the bottom door is in an open position.

Referring now to FIGS. 3 and 4, the upper hinge assembly 98 is illustrated coupled with the door 10 and the appliance body 24. As best shown in FIG. 4, the upper hinge assembly 98 includes an upper hinge mount 110 having a first portion 112 and a second portion 114. The second portion 114 extends substantially perpendicular from the first portion 112. The first portion 112 is configured to be coupled with the front panel 70 of the appliance body 24 such that the second portion 114 extends forward of the front panel 70. In various examples, the front panel 70 of the appliance body 24 may define a recess 118 configured to receive the first portion 112 of the upper hinge mount 110. A plurality of fasteners 120 may be used to couple the first portion 112 with the front panel 70.

Figure 5:
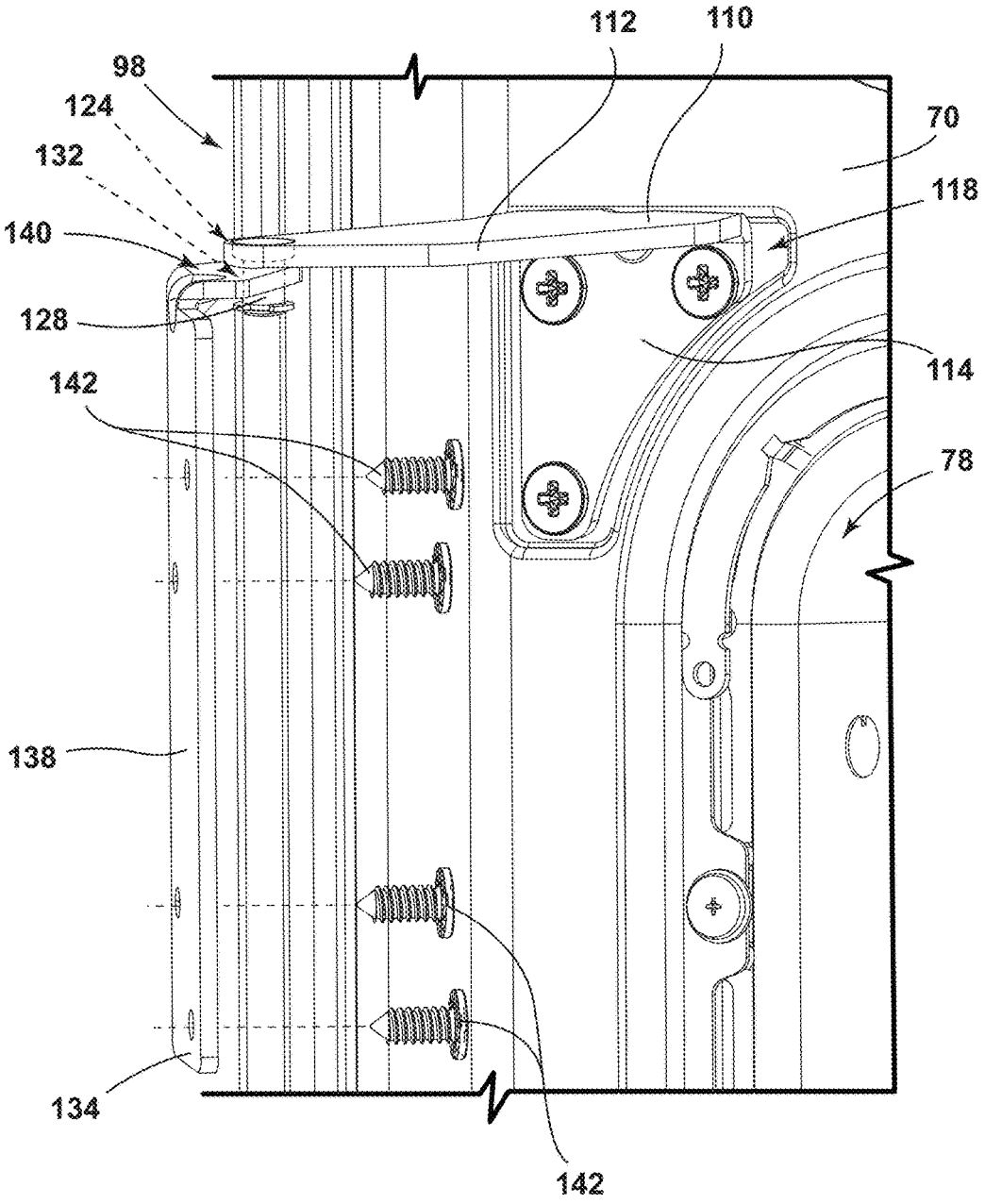
FIG. 5 is a partial front perspective view of the oven appliance and upper hinge assembly of FIG. 4 with the bottom door removed.

Referring now to FIGS. 4 and 5, the second portion 114 extends forward from the front panel 70 and defines a receiving space 124 configured to receive an upper hinge pin 128. The upper hinge pin 128 is fixedly coupled with the second portion 114 of the upper hinge mount 110 and extends downward from the second portion 114. The upper hinge pin 128 is further configured to be received by a receiving well 132 of an upper hinge support 134. The receiving well 132 may have a smaller diameter than the receiving space 124 to securely couple the upper hinge pin 128 with the second portion 114 such that the upper hinge support 134 is rotatable about the upper hinge pin 128.

As best shown in FIG. 5, the upper hinge support 134 includes an elongated coupling plate 138 extending from a hinge arm 140. The coupling plate 138 may be substantially rectangular in shape or may have any other elongated shape. The coupling plate 138 of the upper hinge support 134 is configured to be aligned with and coupled to the vertical support 18 by a plurality of fasteners 142 such that the upper hinge support 134 rotates about the upper hinge pin 128 as the door 10 moves between the open and closed positions. The hinge arm 140 may be positioned substantially perpendicular to the coupling plate 138 and defines the receiving well 132 of the upper hinge support 134 to receive the upper hinge pin 128 to facilitate the rotation of the upper hinge support 134.

Figure 6:
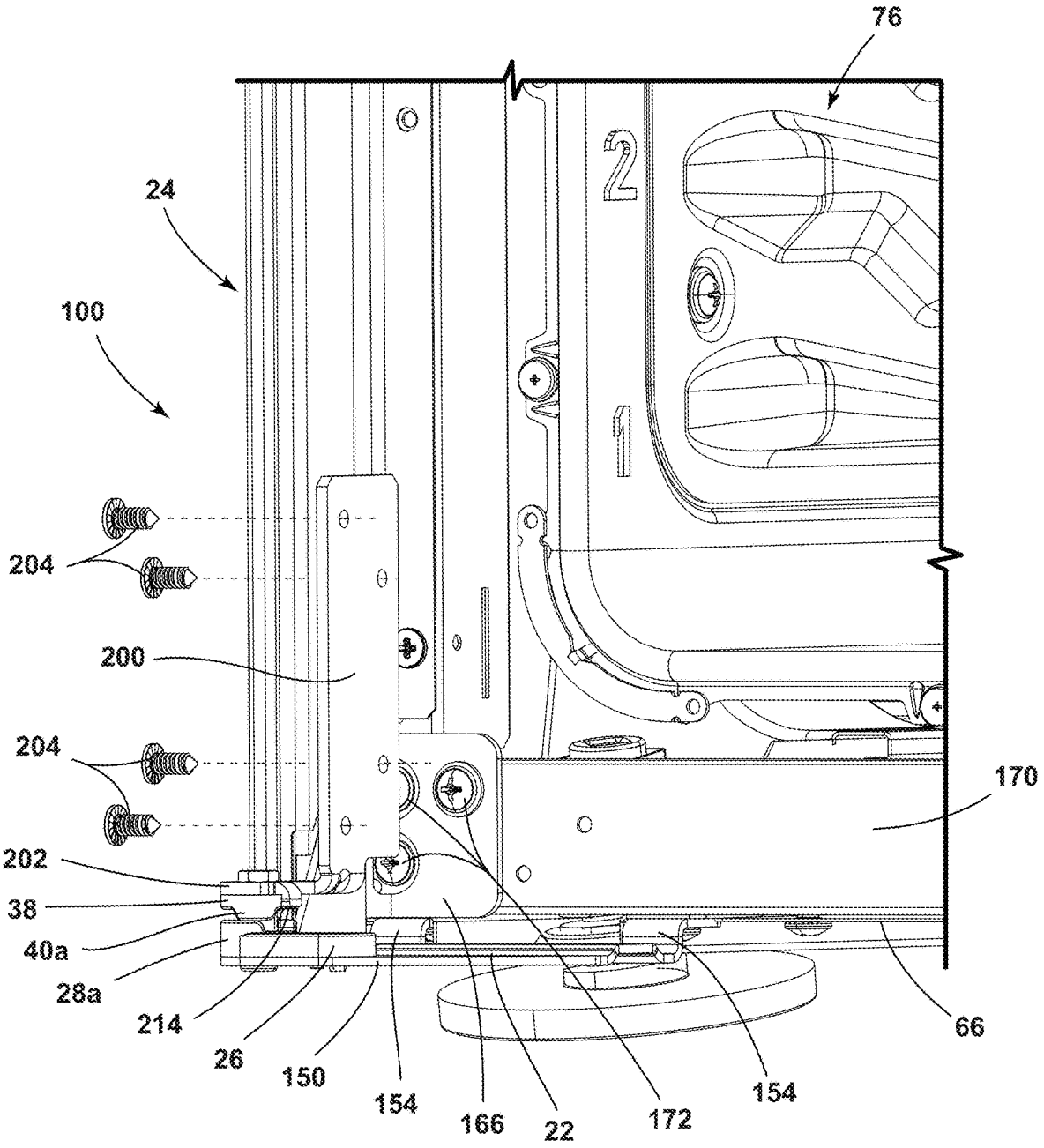
FIG. 6 is a partial front perspective view of the oven appliance of FIG. 1 illustrating a lower hinge assembly of the bottom door with the bottom door removed.
Figure 7:
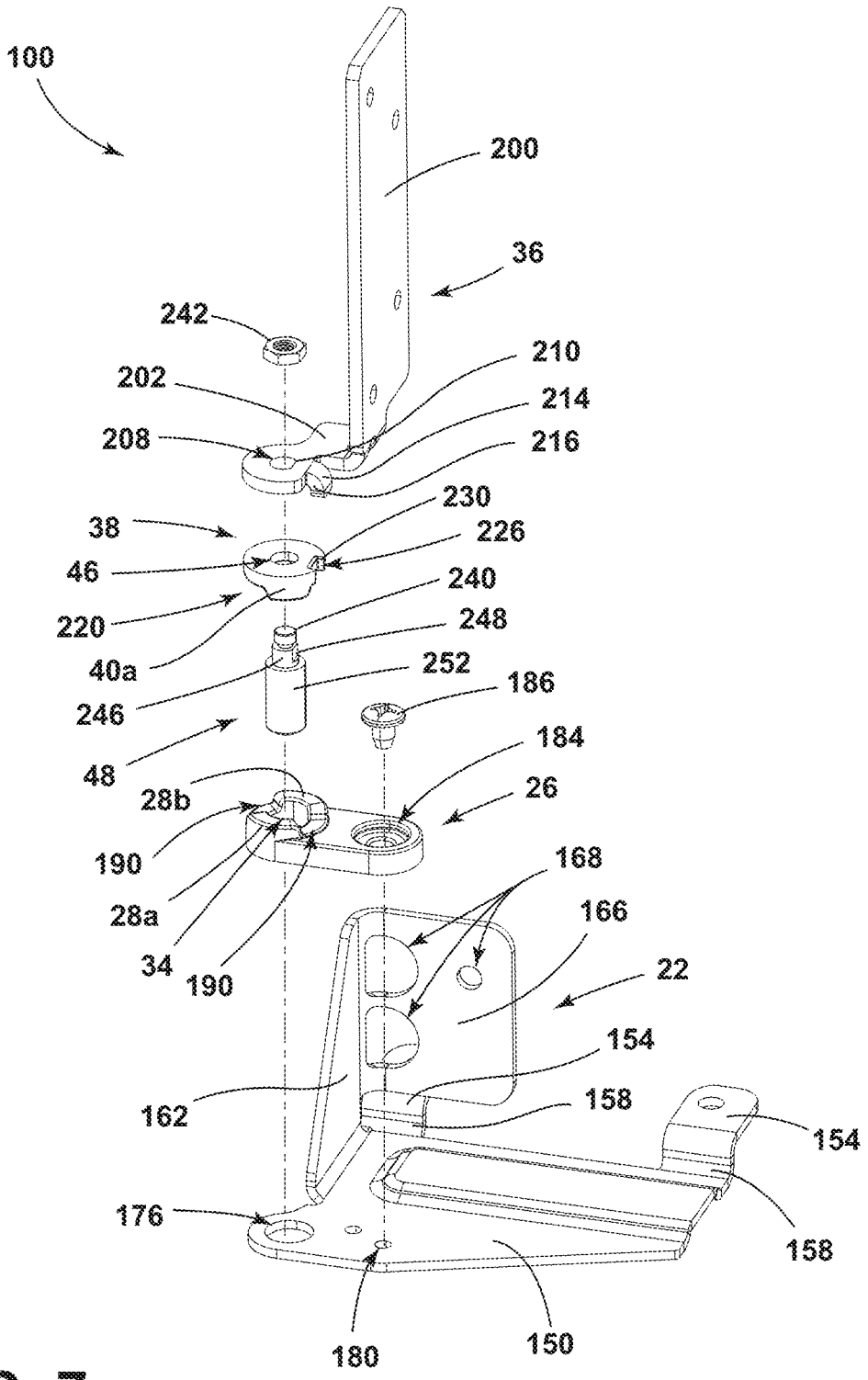
FIG. 7 is an exploded view of the lower hinge assembly of FIG. 6.

Referring now to FIGS. 3 and 6, the lower hinge assembly 100 is illustrated coupled with the door 10 (FIG. 3) and with the door removed (FIG. 6). As best shown in FIGS. 6 and 7, the lower hinge assembly 100 includes the lower hinge mount 22 coupled with a first pivot member 26, also referred to herein as a lower pivot member 26. The lower hinge support 36 is rotatably coupled with the lower hinge mount 22. A second pivot member 38, also referred to herein as an upper pivot member 38, is coupled with the lower hinge support 36 and is configured to engage the first pivot member 26, as described in more detail elsewhere herein.

Figure 8:
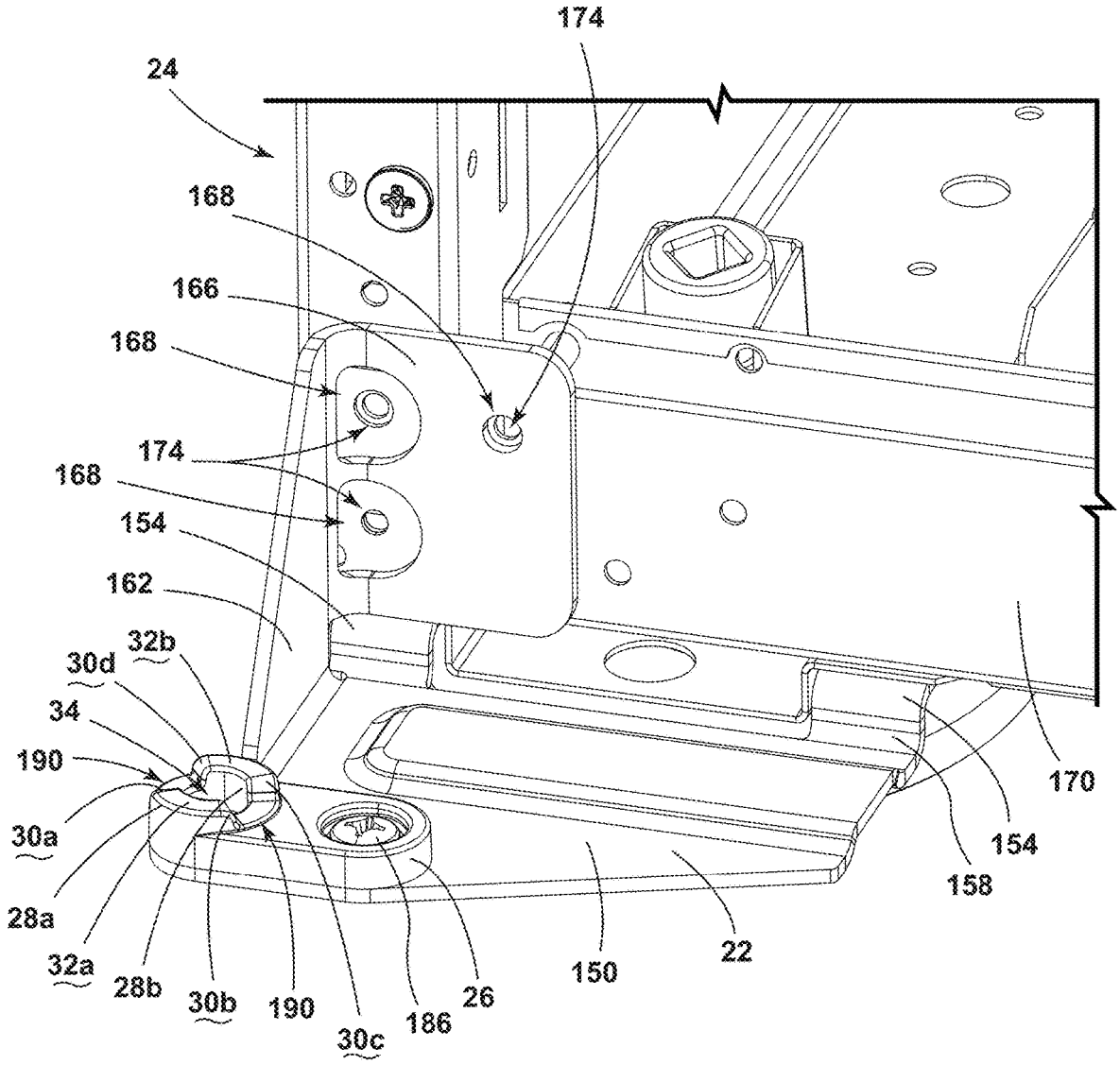
FIG. 8 is a partial front perspective view of a first portion of the lower hinge assembly of FIG. 6 coupled with the appliance.
Figure 9:
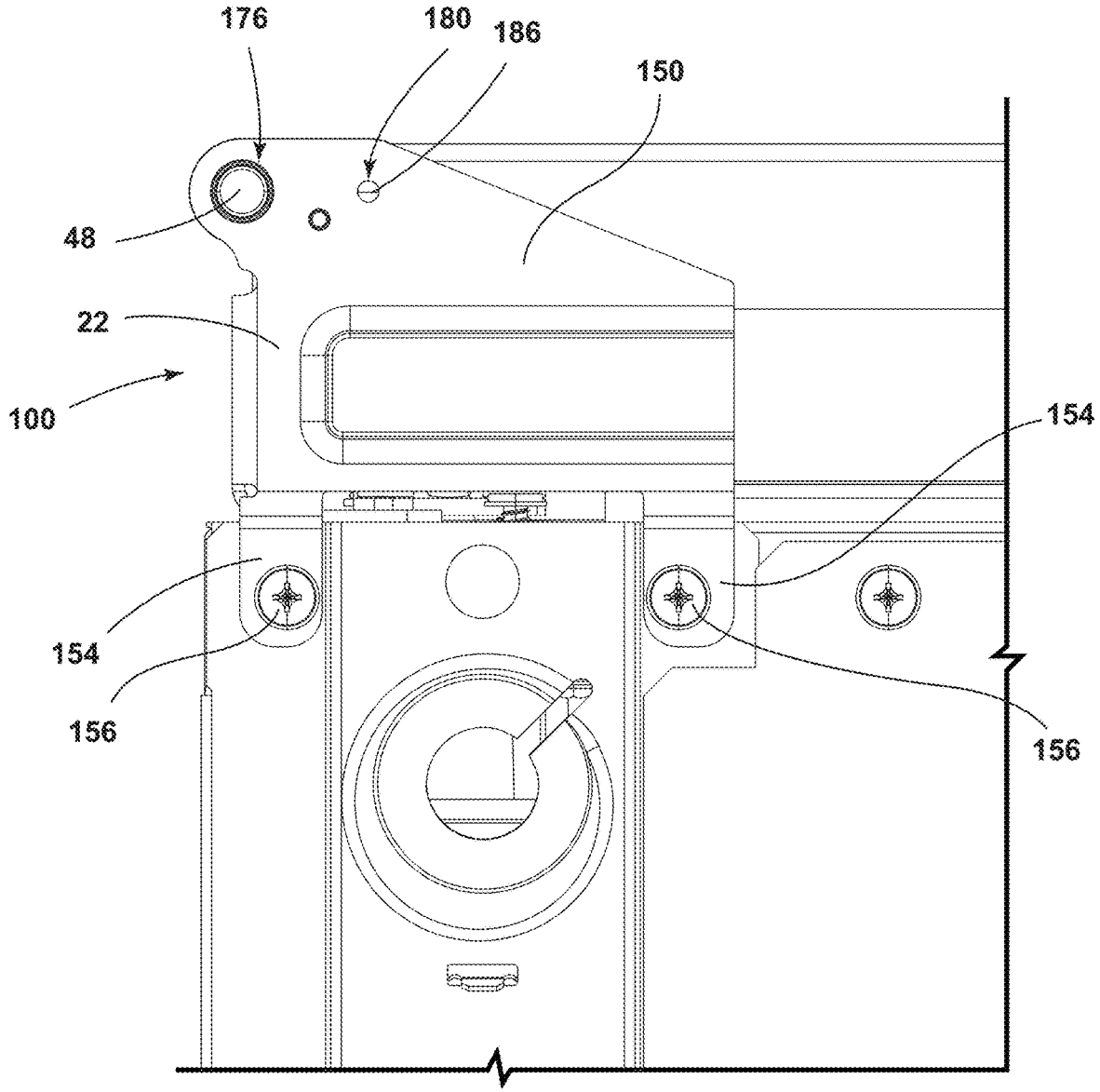
FIG. 9 is a bottom elevation view of the lower hinge assembly of FIG. 8.

Referring now to FIGS. 6-9, the lower hinge mount 22 includes a base plate 150 extending at least partially forward of the appliance body 24. As best shown in FIGS. 7-9, at least one foot 154 is integrally formed with, and extends rearward from, the base plate 150. It will be understood that the lower hinge mount 22 may include any number of feet 154 without departing from the scope of the present disclosure. Each foot 154 is configured to be coupled with the bottom panel 66 of the appliance body 24 by a fastener 156. As shown in FIGS. 8 and 9, each foot 154 may include a step 158 to vertically offset the base plate 150 from the bottom panel 66.

Referring now to FIGS. 6-8, the lower hinge mount 22 further includes a side wall 162 integrally formed with, and extending upward from, the base plate 150. A mounting flange 166 extends perpendicularly from the side wall 162. When the at least one foot 154 is coupled with the bottom panel 66 of the appliance body 24, the mounting flange 166 is aligned with the front panel 70 and a lower support 170 of the appliance body 24. The mounting flange 166 defines a plurality of receiving spaces 168 configured to align with through-holes 174 of the lower support 170. As best shown in FIG. 6, a plurality of fasteners 172 is configured to couple the mounting flange 166 with the lower support 170 and the front panel 70.

As best shown in FIG. 7, the base plate 150 defines a mount pin receptacle 176 configured to at least partially receive the lower hinge pin 48, as described in more detail elsewhere herein. The mount pin receptacle 176 is defined proximate the side wall 162 and a forward edge of the base plate 150. The base plate 150 further defines a mount aperture 180 proximate the mount pin receptacle 176 and the forward edge of the base plate 150.

As best shown in FIGS. 7 and 8, the first pivot member 26 may be generally oblong and is configured to be coupled with the base plate 150. The first pivot member 26 defines a member aperture 184 at a first end of the first pivot member 26. The member aperture 184 is configured to align with the mount aperture 180 of the base plate 150. A fastener 186 is positioned through the apertures 180, 184 to couple the first pivot member 26 with the base plate 150.

The first pivot member 26 further defines the first pin receptacle 34 at a second end of the first pivot member 26. The first pin receptacle 34 is aligned with the mount pin receptacle 176 when the fastener 186 is positioned through the apertures 180, 184. The first pin receptacle 34 is also configured to at least partially receive the lower hinge pin 48, as described in more detail elsewhere herein.

As best shown in FIG. 8, the first pivot member 26 includes upwardly extending protrusions 28*a*, 28*b* extending at least partially about a circumference of the first pin receptacle 34. As illustrated, the upwardly extending protrusions 28*a*, 28*b* include a first protrusion 28*a* and a second protrusion 28*b*. The first protrusion 28*a* includes a first inclined surface 30*a* and a second inclined surface 30*b*, and the second protrusion 28*b* includes a third inclined surface 30*c* and a fourth inclined surface 30*d*. The inclined surfaces 30*a*-30*d* extend downward and outward from a corresponding horizontal surface 32*a*, 32*b* of the respective first or second protrusion 28*a*, 28*b*. The first and second protrusions 28*a*, 28*b* are spaced apart by at least one receiving well 190.

Figure 10A:
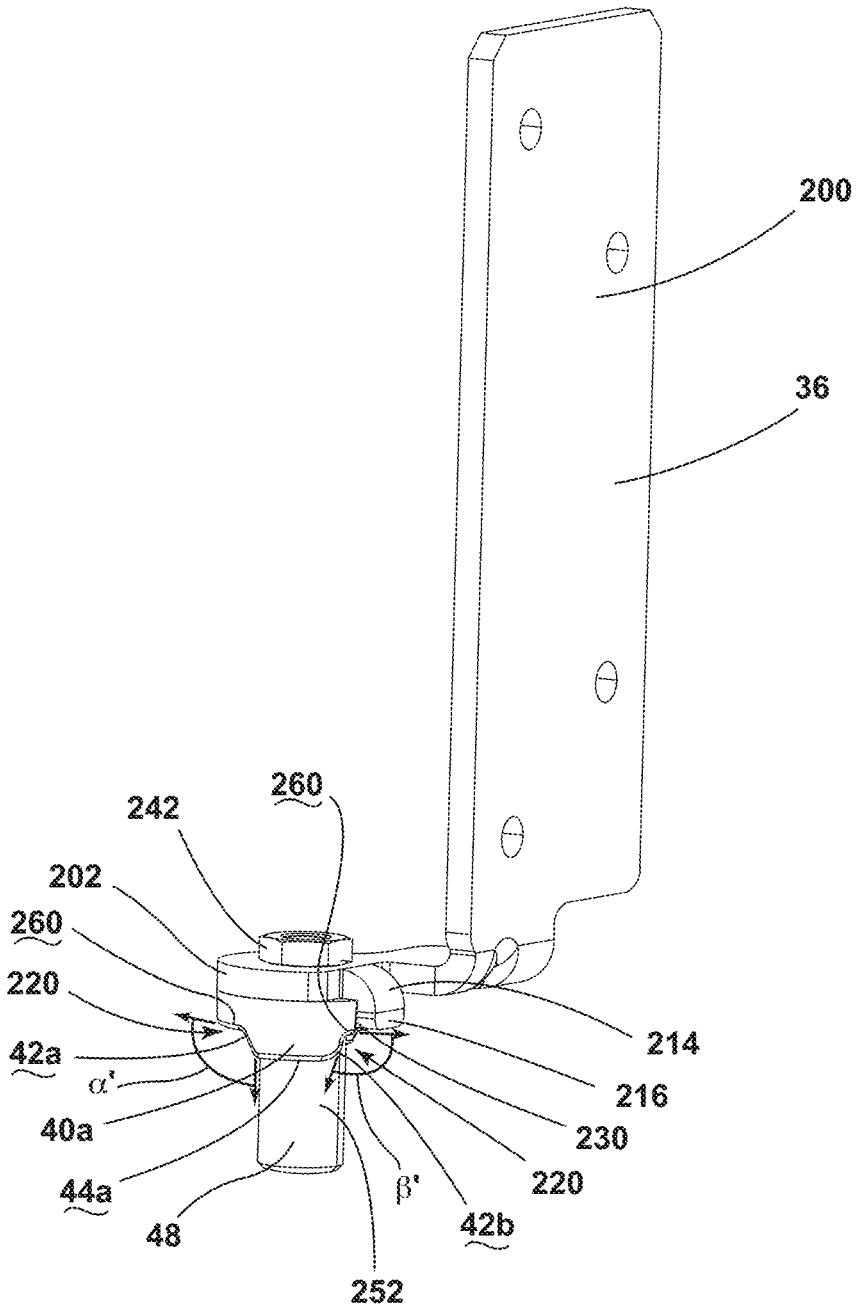
FIG. 10A is a first side perspective view of a second portion of the bottom hinge assembly of FIG. 6.
Figure 10B:
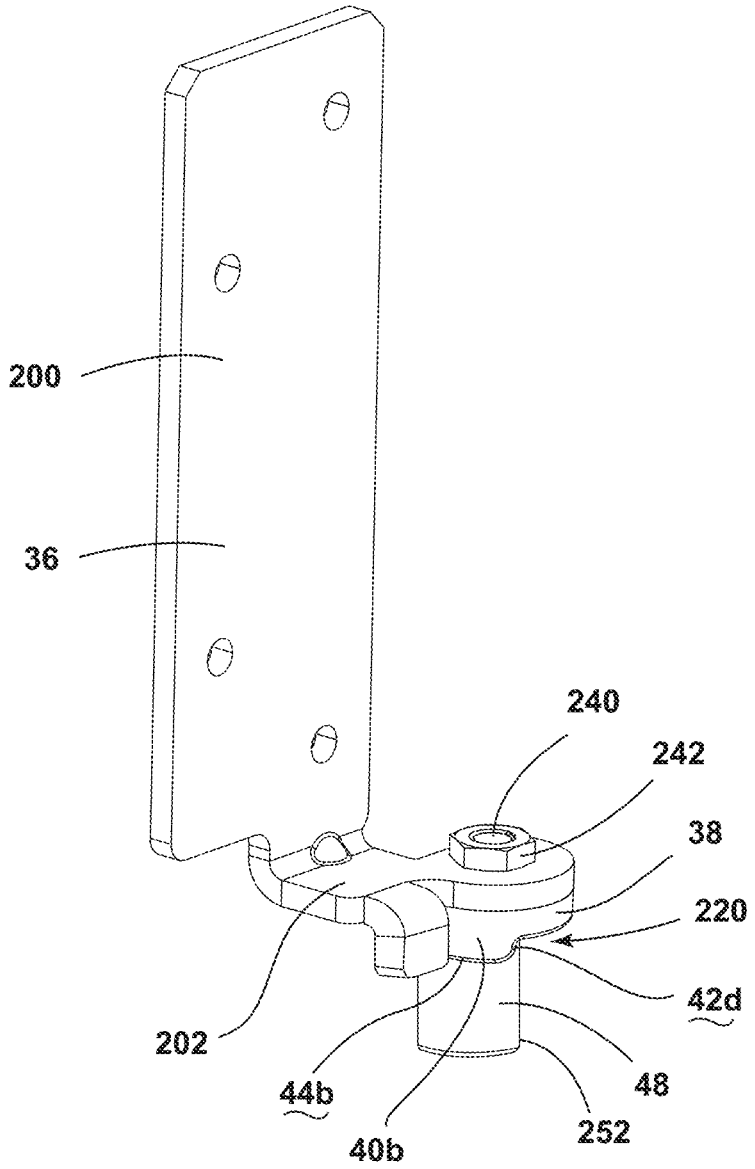
FIG. 10B is a second side perspective view of the second portion of the bottom hinge assembly of FIG. 10A.

Referring now to FIGS. 10A and 10B, the lower hinge assembly 100 further includes the lower hinge support 36. The lower hinge support 36 includes an elongated coupling plate 200 integrally formed with a hinge arm 202. The coupling plate 200 may be substantially rectangular in shape or may have any other elongated shape. As shown in FIG. 3, the coupling plate 200 of the lower hinge support 36 is configured to be aligned with, and coupled with, the vertical support 18 by a plurality of fasteners 204 such that the lower hinge support 36 rotates about the lower hinge pin 48 as the door 10 moves between the open and closed positions. The upper hinge support 134 may be coupled at an upper end of the vertical support 18, and the lower hinge support 36 may be coupled at a lower, opposite end of the vertical support 18. The lower and upper hinge supports 36, 134 are rotatable simultaneously and in conjunction with the vertical support 18 to rotate the door 10 between open and closed positions.

Referring again to FIGS. 10A and 10B, the hinge arm 202 may be positioned substantially perpendicular to the coupling plate 200 and defines a support pin receptacle 208. The support pin receptacle 208 is configured to be aligned with at least the mount pin receptacle 176 and the first pin receptacle 34 and is configured to at least partially received the lower hinge pin 48.

As best shown in FIG. 7, the hinge arm 202 includes an interior linear edge 210. The interior linear edge 210 at least partially defines the support pin receptacle 208 and is configured to maintain the position of the lower hinge pin 48 within the support pin receptacle 208, as discussed in more detail elsewhere herein. In other words, the interior linear edge 210 is configured such that the lower hinge pin 48 is rotationally fixed (i.e., not rotatable) within the support pin receptacle 208.

Referring now to FIGS. 7 and 10A, the lower hinge support 36 further includes a stop 214 extending outward and at least partially downward from the hinge arm 202. The stop 214 includes at least one linear side 216. In other words, the stop 214 may have a single linear side 216 or may have a pair of opposing linear sides 216. Each linear side 216 is configured to be engaged with and contact a portion of the second pivot member 38 to retain the position of the second pivot member 38 relative to the lower hinge support 36.

As previously introduced, the second pivot member 38 is coupled with the lower hinge support 36. The second pivot member 38 includes one or more linear edges 230 extending radially along the second pivot member 38 and at least partially defining a receiving space 226. The receiving space 226 is configured to receive the stop 214 of the lower hinge support 36. When the stop 214 is received by the receiving space 226, the linear edge 230 of the second pivot member 38 is in contact with the linear side 216 of the stop 214. The contact between the linear side 216 and the linear edge 230 facilitates rotation of the second pivot member 38 in conjunction with the lower hinge support 36.

Referring again to FIGS. 10A and 10B, the second pivot member 38 includes downwardly extending protrusions 40*a*, 40*b* extending at least partially about a circumference of the second pin receptacle 46. As illustrated, the downwardly extending protrusions 40*a*, 40*b* include a first protrusion 40*a* and a second protrusion 40*b*. The first protrusion 40*a* includes a first inclined surface 42*a* and a second inclined surface 42*b*, and the second protrusion 40*b* includes a third inclined surface 42*c* and a fourth inclined surface 42*d*. The inclined surfaces 42*a*-42*d* extend downward and outward from a corresponding horizontal surface 44*a*, 44*b* of the respective first or second protrusion 40*a*, 40*b*. The first and second protrusions 40*a*, 40*b* are spaced apart by at lea 220.

As best shown in FIG. 7, the lower hinge assembly 100 further includes the lower hinge pin 48 including a coupling end 240 integrally formed with and extending from a central portion 246. The coupling end 240 is configured to extend past the support pin receptacle 208 of the hinge arm 202 of the lower hinge support 36 and engage with a nut 242. The central portion 246 is configured to be received by the support pin receptacle 208 and includes at least one linear surface 248. The linear surface 248 is configured to be engaged with the interior linear edge 210 of the hinge arm 202. The engagement between the interior linear edge 210 and the linear surface 248 guides the insertion of the lower hinge pin 48 into the support pin receptacle 208. The engagement further acts to fixedly couple the lower hinge pin 48 with the second pivot member 38 such that the lower hinge pin 48 and the second pivot member 38 rotate in conjunction with the lower hinge support 36.

The lower hinge pin 48 further includes a body 252. The body 252 is configured to extend through the first and second pin receptacles 34, 46 and the mount pin receptacle 176. The body 252 includes a substantially cylindrical shape such that the body 252 is rotatable within the receptacles 34, 46, 176. The body 252 is further configured to be vertically translated through the receptacles 34, 46, 176 as the lower hinge support 36 is moved from the first position to the second position, as discussed in more detail elsewhere below. In other words, the body 252 of the lower hinge pin 48 is vertically translatable within the first and second pin receptacles 34, 46 and the mount pin receptacle 176.

In operation, the second pivot member 38, and the lower hinge pin 48 are rotated with the lower hinge support 36 to rotate the door 10 from an open position to a closed position. The first position of the lower hinge support 36 (FIG. 11) corresponds with the closed position of the door 10 and the second position of the lower hinge support 36 (FIG. 14) corresponds with the open position of the door 10. As illustrated, the lower hinge support 36 is also configured to be retained in an intermediate position (FIG. 13) to place the door 10 in a partially open position (not shown). It is contemplated that the door 10 may be retained in any number of intermediate positions based on the configuration of the pivot members 26, 38 without departing from the scope of the present disclosure.

Figure 11:
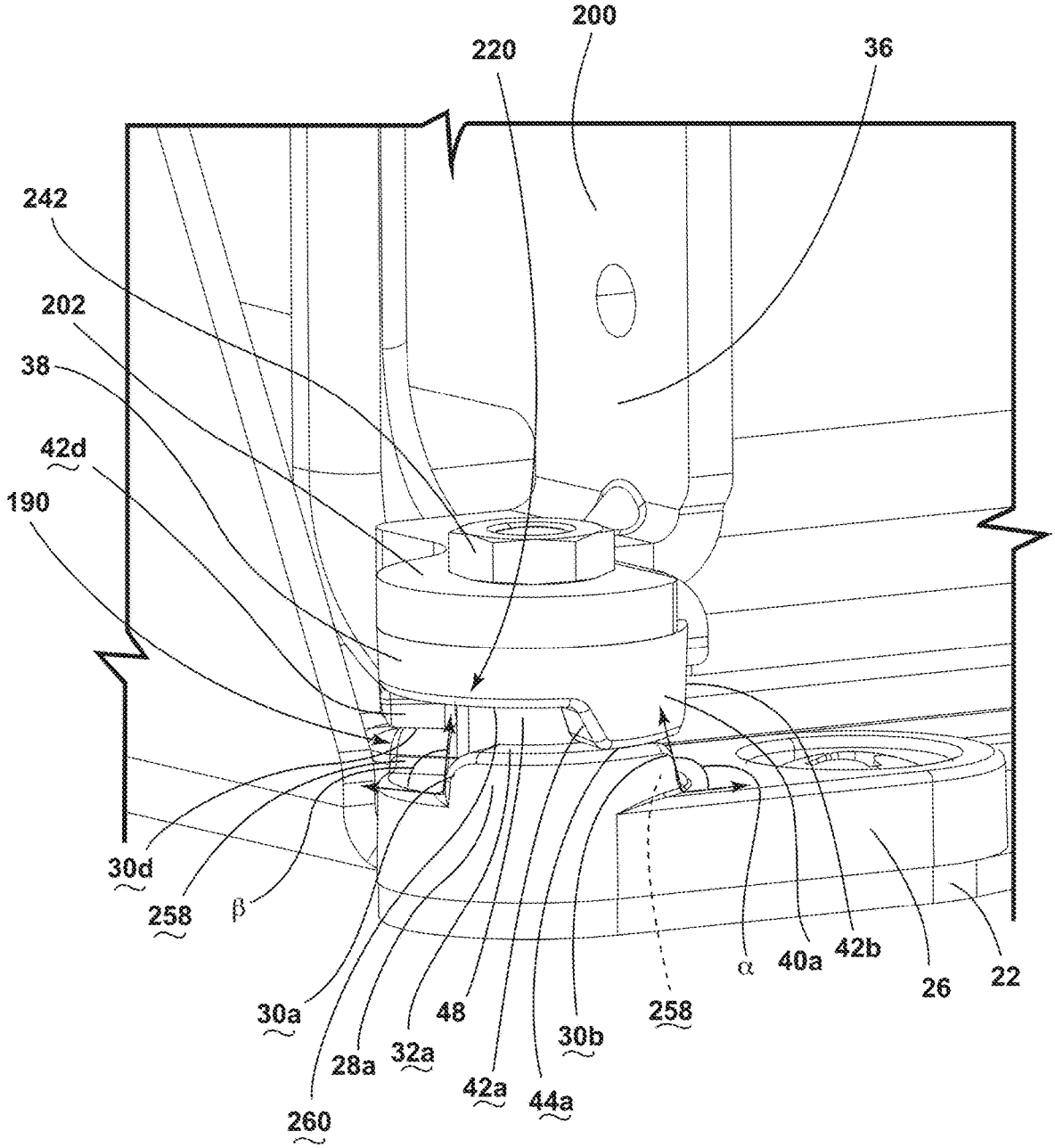
FIG. 11 is a side perspective view of the lower hinge assembly of FIG. 6 removed from the appliance and in a first position.

Referring now to FIGS. 10A-11, the first and second protrusions 28*a*, 28*b* of the first pivot member 26 include inclined surfaces 30*a*-30*d*. The second and fourth inclined surfaces 30*b*, 30*d* may be oriented at a first angle $\alpha$ relative to an interior surface 258 of the first pivot member 26. The first and third inclined surfaces 30*a*, 30*c* may be oriented at a second angle $\beta$ relative to the interior surface 258 of the first pivot member 26. The angle $\alpha$ may be configured to be larger than the angle $\beta$. Alternatively, the angle $\alpha$ may be configured to be the same or substantially the same as angle $\beta$.

The first and second protrusions 40*a*, 40*b* of the second pivot member 38 include inclined surfaces 42*a*-42*d*. The first and third inclined surfaces 42*a*, 42*c* may be configured as engagement surfaces and may be oriented at a first angle $\alpha'$ relative to an interior surface 260 of the second pivot member 38. The second and fourth inclined surfaces 42*b*, 42*d* may be configured as retention surfaces and may be oriented at a second angle $\beta'$ relative to the interior surface 260 of the second pivot member 38. The angle $\alpha'$ may be configured to be larger than the angle $\beta'$. Alternatively, the angle $\alpha'$ may be configured to be the same or substantially the same as angle $\beta'$. It is contemplated that the angles $\alpha$ and $\alpha'$ may be substantially the same size or may be different sizes, and it is further contemplated that the angles $\beta$ and $\beta'$ may be substantially the same size or may be different sizes without departing from the scope of the present disclosure.

Referring now to FIG. 11, the lower hinge support 36 is shown in the first position. The horizontal surface 32*a* of the first protrusion 28*a* of the first pivot member 26 is in contact with the horizontal surface 44*a* of the first protrusion 40*a* of the second pivot member 38. In the first position, the horizontal surface 32*b* of the second protrusion 28*b* is also in contact with the horizontal surface 44*b* of the second protrusion 40*b*.

Figure 12:
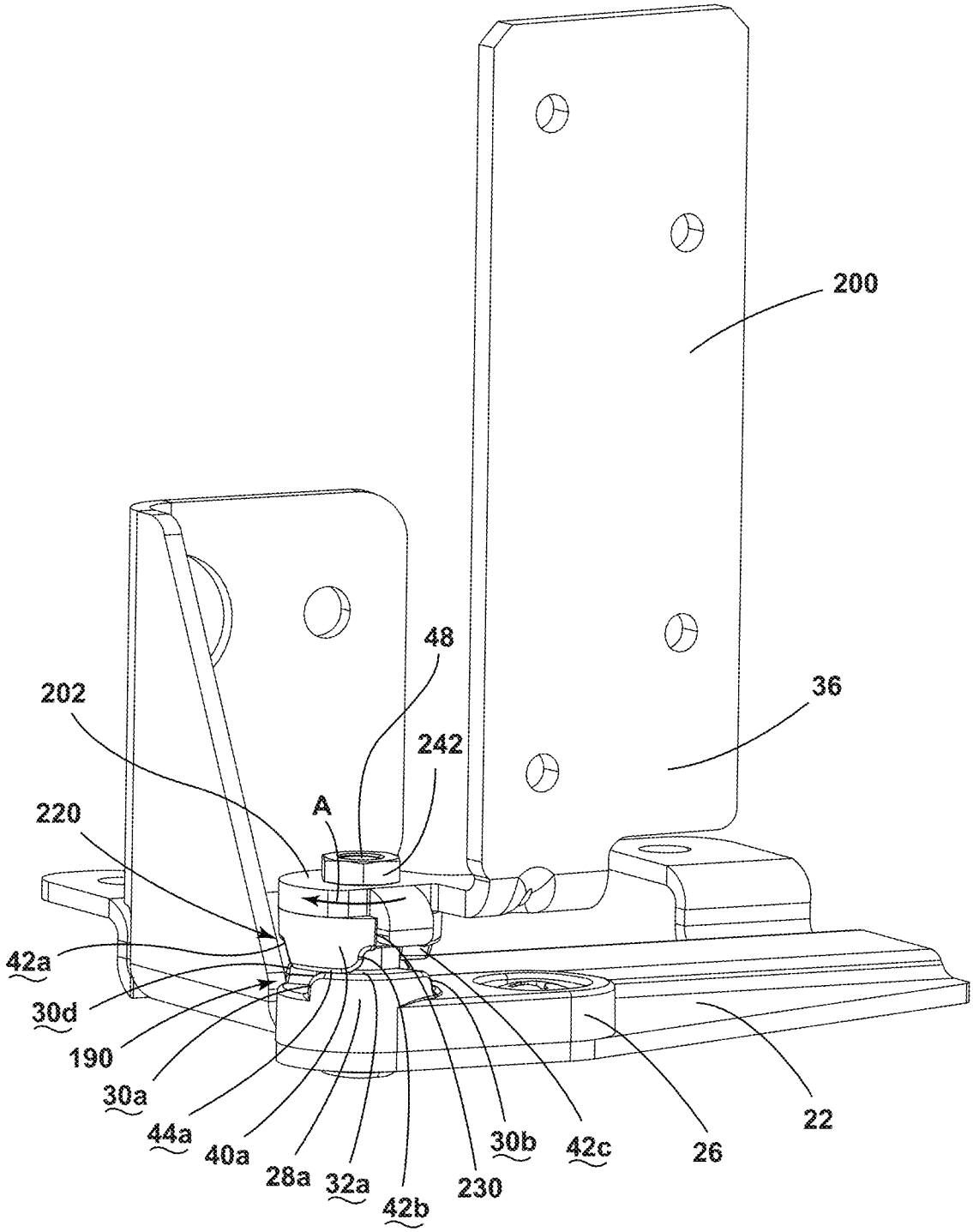
FIG. 12 is a side perspective view of the lower hinge assembly of FIG. 11 in an intermediate position.
Figure 13:
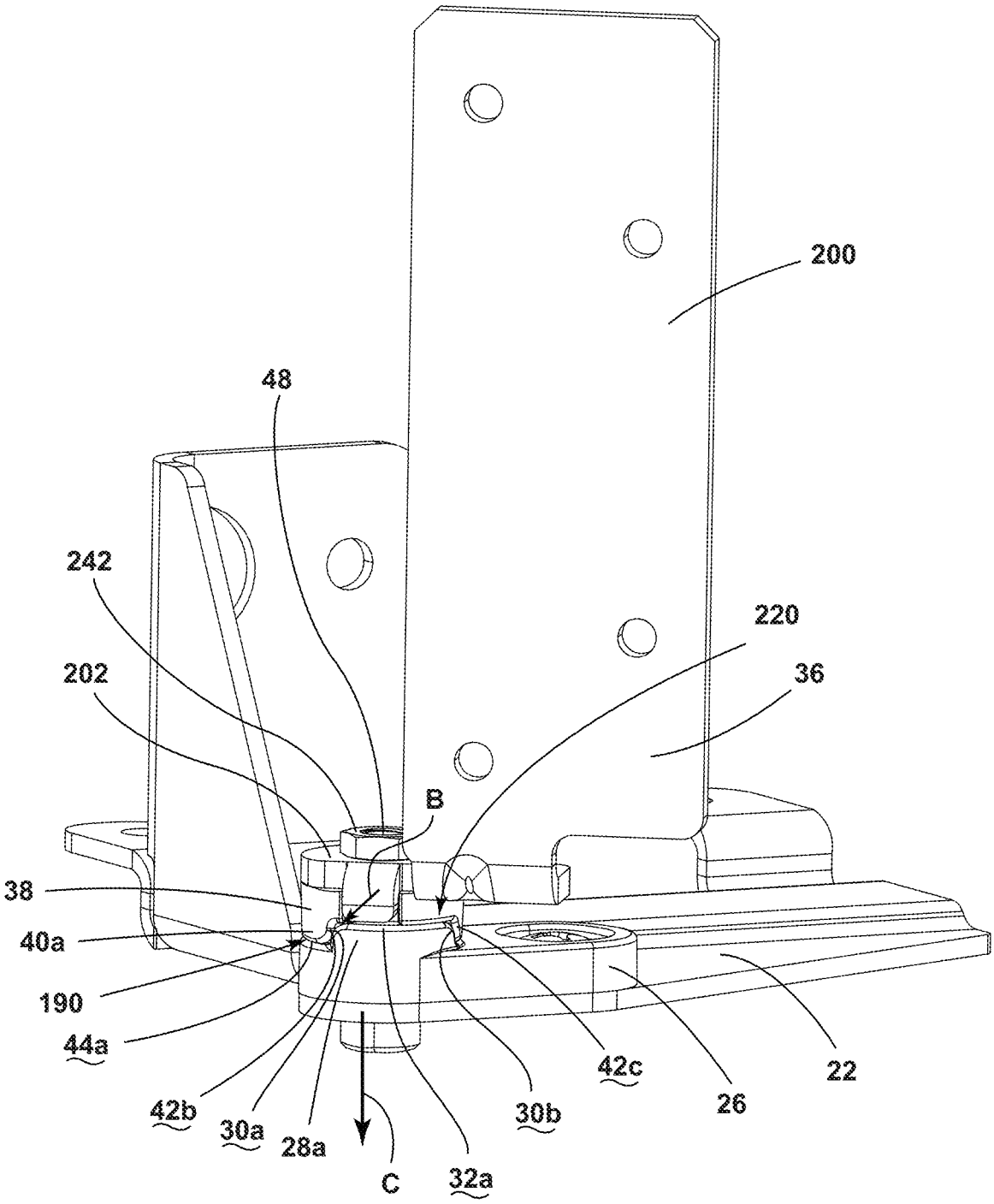
FIG. 13 is a side perspective view of the lower hinge assembly of FIG. 11 in an intermediate position.
Figure 14:
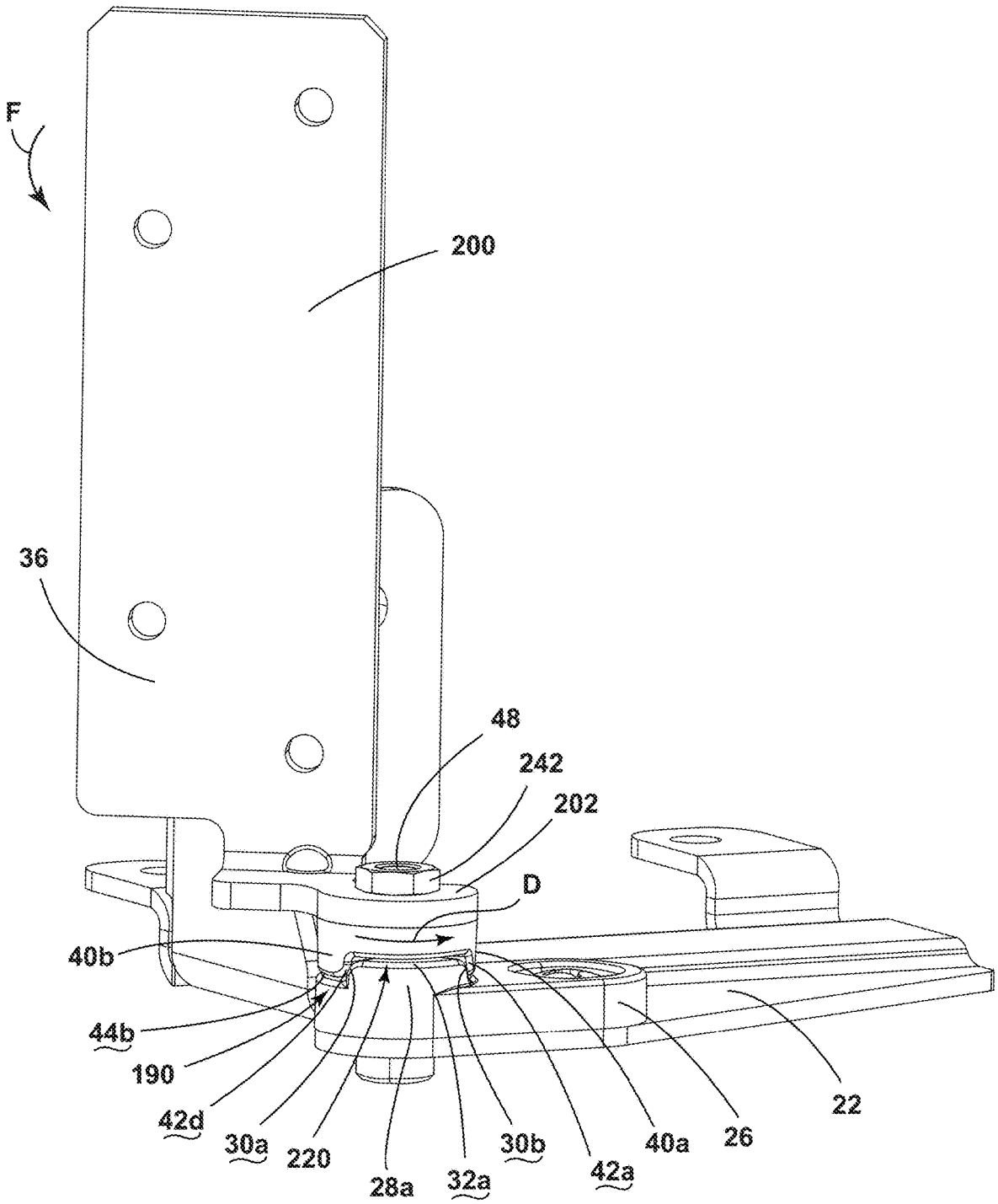
FIG. 14 is a side perspective view of the lower hinge assembly of FIG. 11 in a second position.

As best shown in FIG. 12, the second pivot member 38 is rotated in a first direction (arrow A) from the first position (FIG. 11) to an intermediate position (FIG. 13). Each of the horizontal surfaces 44*a*, 44*b* of the first and second protrusions 40*a*, 40*b* of the second pivot member 38 is slidably engaged with the horizontal surface 32*a*, 32*b* of the corresponding protrusion of the first and second protrusions 28*a*, 28*b* of the first pivot member 26. The horizontal surfaces 44*a*, 44*b* are configured to slide along the corresponding horizontal surfaces 32*a*, 32*b* as the lower hinge support 36 is rotated from the first position into the intermediate position.

Referring now to FIGS. 12 and 13, each of the horizontal surfaces 44*a*, 44*b* is configured to slide along the corresponding horizontal surface 32*a*, 32*b* until one of the protrusions 40*a*, 40*b* is proximate the receiving well 190 of the first pivot member 26, as shown in FIG. 13. As illustrated, when the first protrusion 40*a* overlaps the receiving well 190, the second inclined surface 42*b* of the first protrusion 40*a* of the second pivot member 38 slides downward to along arrow B to be in contact with the first inclined surfaces 30*a* of the first protrusion 28*a* of the first pivot member 26. It will be understood that the first pivot member 26 may further define a second receiving well 190, as previously discussed, configured to receive the second protrusion 40*b* in the same or a similar manner such that the fourth inclined surface 42*d* of the second protrusion 40*b* slides into contact with the third inclined surface 30*c* of the second protrusion 28*b*.

As shown in FIG. 13, in the intermediate position, at least one of the protrusions 40*a*, 40*b* of the second pivot member 38 is received by a receiving well 190 of the first pivot member 26. Likewise, at least one of the protrusions 28*a*, 28*b* of the first pivot member 26 is received by a receiving well 220 of the second pivot member 38. When the protrusions 28*a*, 28*b* and 40*a*, 40*b* are engaged with the respective receiving wells 190, 220, the lower hinge pin 48 is vertically translated downward along arrow C. The receiving wells 190, 220 and protrusions 28*a*, 28*b* and 40*a*, 40*b* may be configured such that the first and third inclined surfaces 42*a*, 42*c* of the protrusions 40*a*, 40*b* of the second pivot member 38 are in contact with the second and fourth inclined surfaces 30*b*, 30*d* of the corresponding protrusion 28*a*, 28*b* of first pivot member 26. Alternatively, the receiving wells 190, 220 and protrusions 28*a*, 28*b* and 40*a*, 40*b* may be configured such that the first and third inclined surfaces 42*a*, 42*c* of the protrusions 40*a*, 40*b* of the second pivot member 38 are spaced apart from the second and further inclined surfaces 30*b*, 30*d* of the protrusions 28*a*, 28*b* of the first pivot member 26.

The lower hinge support 36 and the second pivot member 38 are further rotatable in the first direction (see arrow A of FIG. 12) to move the lower hinge support 36 from the intermediate position to the second position, as shown in FIG. 14. In other words, the second pivot member 38, in conjunction with the lower hinge support 36, is rotatable another 180 degrees along in the first direction such that the second protrusion 40*b* of the second pivot member 38 is received within the receiving well 190. When the second pivot member 38 is rotated from the intermediate position in the first direction, the first and third inclined surfaces 42*a*, 42*c* of the first and second protrusions 40*a*, 40*b* of the second pivot member 38 slide upward along the second and fourth inclined surfaces 30*b*, 30*d* of the first or second protrusion 28*a*, 28*b* of the first pivot member 26 until the horizontal surfaces 44*a*, 44*b* of the second pivot member 38 are in slidable contact corresponding horizontal surfaces 32*a*, 32*b* of the first pivot member 26.

The lower hinge support 36 is further rotated in the first direction until the second protrusion 40*b* is received by the receiving well 190 of the first pivot member 26, as shown in FIG. 14. The angles $\alpha$ and $\alpha'$ are sized to create a lower slope along the engagement surfaces and facilitate rotation of the second pivot member 38 in the first direction, and the angles $\beta$ and $\beta'$ are sized to allow the retention surfaces to act as stops and require a larger force to rotate the second pivot member 38 in a second direction opposite the first direction, as shown by arrow D of FIG. 14. When the second protrusion 40*b* is received by the receiving well 190 of the first pivot member 26, the fourth inclined surface 42*d* is in contact with the first inclined surface 30*a* of the first protrusion 28*a* of the first pivot member 26 such that the lower hinge support 36 and the second pivot member 38 are substantially retained in the second position. To move the lower hinge support 36 and the second pivot member 38 back to the first position, and to move the door 10 into the closed position, a force F must be applied to overcome the contact between the fourth inclined surface 42*d* and the first inclined surface 30*a* and rotate the lower hinge support 36 and the second pivot member 38 in the second direction.

According to one aspect, an appliance includes a door having a plurality of panels spaced apart by a vertical support. A lower hinge mount is coupled with an appliance body. A first pivot member is coupled with the lower hinge mount and defines a first pin receptacle. The first pivot member includes a first protrusion having a first inclined surface and a first horizontal surface. A lower hinge support is fixedly coupled with the vertical support and is rotatable between first and second positions relative to the first pivot member. A second pivot member is coupled with the lower hinge support and defines a second pin receptacle. The second pivot member includes a second protrusion having a second inclined surface and a second horizontal surface. The second horizontal surface contacts the first horizontal surface in the first position. A lower hinge pin is coupled with the lower hinge support and is vertically translated within the first and second pin receptacles when the second pivot member moves from the first position to the second position.

According to another aspect, first and second positions of a lower hinge support correspond with closed and open positions of a door, respectively.

According to another aspect, a second inclined surface of a second protrusion contacts a first inclined surface of a first protrusion in a second position.

According to another aspect, an appliance includes an upper hinge mount coupled with an appliance body, an upper hinge support fixedly coupled with a vertical support, and an upper hinge pin extending downward from the upper hinge mount. The upper hinge support is rotatable about the upper hinge pin.

According to another aspect, a door is rotatable about a vertical axis extending between upper and lower hinge pins.

According to another aspect, a second pivot member includes a linear edge defining a receiving well, and a lower hinge support includes a stop configured to be received within the receiving well and abut the linear edge.

According to another aspect, a first protrusion of a first pivot member at least partially defines a receiving space, and a second protrusion is received by the receiving space when a second pivot member is in a second position.

According to another aspect, a lower hinge mount is coupled with a bottom panel of the appliance body.

According to another aspect, an appliance includes a door rotatable between open and closed positions. A lower hinge mount is coupled with an appliance body. A first pivot member is coupled with the lower hinge mount and defines a first pin receptacle. The first pivot member includes a first protrusion having a first inclined surface and a first horizontal surface. A second pivot member defines a second pin receptacle aligned with the first pin receptacle and includes a second protrusion having a second inclined surface and a second horizontal surface. The second pivot member is rotatable relative to the first pivot member between first and second positions. The second horizontal surface contacts the first horizontal surface in the first position, and the second inclined surface contacts the first inclined surface in the second position. A lower hinge pin is coupled with the second pivot member to rotate with the second pivot member. The lower hinge pin is vertically translated through the first and second pin receptacles when the second pivot member moves from the first position to the second position.

According to another aspect, an appliance includes a lower hinge support coupled with a door and defining a support pin receptacle aligned with first and second pin receptacles. The support pin receptacle is at least partially defined by an interior linear edge of the lower hinge support.

According to another aspect, a lower hinge pin includes a central portion having a linear side and extending from a body. The central portion is received by a support pin receptacle and the linear side is in contact with an interior linear edge of a lower hinge support to couple the lower hinge pin to rotate with the lower hinge support.

According to another aspect, a body of a lower hinge pin is received by and vertically translatable through first and second pin receptacles.

According to another aspect, a lower hinge support includes a stop, and a second pivot member defines a receiving space. The stop is received by the receiving space to fixedly couple the second pivot member with the lower hinge support.

According to another aspect, a lower hinge mount includes a foot coupled with a bottom panel of an appliance body.

According to another aspect, first and second positions of a second pivot member correspond with closed and open positions of a door, respectively.

According to another aspect, a lower hinge assembly for an appliance door includes a lower pivot member coupled with a hinge mount and defining a first pin receptacle. The lower pivot member includes a lower protrusion having first and second inclined surfaces extending from a first horizontal surface. An upper pivot member defines a second pin receptacle aligned with the first pin receptacle and includes an upper protrusion having third and fourth inclined surfaces and a second horizontal surface. The upper pivot member is rotatable between first and second positions relative to the lower pivot member. The second horizontal surface is in contact with the first horizontal surface in the first position, and the third inclined surface is in contact with the second inclined surface in the second position. A lower hinge pin extends through the first and second pin receptacles and is coupled to rotate in conjunction with the upper pivot member. The lower hinge pin is vertically translated within the first and second pin receptacles when the upper pivot member moves from the first position to the second position.

According to another aspect, an upper pivot member is rotatable into an intermediate position between first and second positions, and a fourth inclined surface is in contact with a first inclined surface in the intermediate position.

According to another aspect, a first inclined surface is oriented at a first angle relative to an interior surface of a lower pivot member, and a fourth inclined surface is oriented at a second angle relative to an interior surface of an upper pivot member. The first angle is substantially the same as the second angle.

According to another aspect, a lower pivot member defines a receiving well and a second protrusion of an upper pivot member is received by the receiving well in a second position.

According to another aspect, a lower hinge assembly includes a lower hinge support including a stop. An upper pivot member defines a receiving space, and the stop is received by the receiving space to fixedly couple the upper pivot member with the lower hinge support.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members, or connector, or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance comprising:

a door including a plurality of panels spaced apart by a vertical support;

a lower hinge mount coupled with an appliance body;

a first pivot member coupled with the lower hinge mount and including a first protrusion;

a lower hinge support fixedly coupled with the vertical support and including an elongate coupling plate and a hinge arm extending orthogonal relative to a longitudinal extent of the elongate coupling plate;

a stop extending from the hinge arm;

a second pivot member having a receiving space that receives the stop, the second pivot member including a second protrusion in abutting contact with the first protrusion; and a lower hinge pin extending through the lower hinge support and the second pivot member, wherein the lower hinge pin is vertically translated when the second pivot member moves from a first position to a second position, and wherein the stop is monolithic with the lower hinge support, the stop extending toward the second pivot member, and further wherein the stop is received within the receiving space defined by the second pivot member to non-rotatably couple the second pivot member with the lower hinge support.

2. The appliance of claim 1, wherein the second pivot member includes an inclined surface that contacts an inclined surface of the first protrusion.

3. The appliance of claim 1, wherein the lower hinge mount is operably coupled with a foot that extends from a bottom panel of the appliance body.

4. The appliance of claim 1, further comprising:

an upper hinge pin extending downward from an upper hinge mount, wherein an upper hinge support is rotatable about the upper hinge pin.

5. The appliance of claim 4, wherein the door is rotatable about a vertical axis extending between the upper and lower hinge pins.

6. The appliance of claim 1, wherein the lower hinge pin also extends through the first pivot member.

7. The appliance of claim 1, wherein the first protrusion of the first pivot member at least partially defines a receptacle, and further wherein the second protrusion is received by the receptacle when the second pivot member is in the second position.

8. The appliance of claim 1, wherein the lower hinge mount is coupled with a bottom panel of the appliance body.

9. An appliance, comprising:

a lower hinge mount coupled with an appliance body and a door;

a first pivot member coupled with the lower hinge mount and defining a first pin receptacle, wherein the first pivot member includes a first protrusion having a first inclined surface;

a second pivot member defining a second pin receptacle aligned with the first pin receptacle and including a second protrusion having a second inclined surface, wherein the second pivot member is rotatable relative to the first pivot member between first and second positions, and further wherein the second inclined surface contacts the first inclined surface in the second position;

a lower hinge pin coupled with the second pivot member to rotate with the second pivot member, wherein the lower hinge pin is vertically translated through the first pin receptacle when the second pivot member moves from the first position to the second position; and a lower hinge support coupled with the door and defining a support pin receptacle aligned with the first and second pin receptacles, wherein the lower hinge support further includes a stop monolithic with the lower hinge support, the stop extending toward the second pivot member, and wherein the second pivot member defines a receiving space that receives the stop to non-rotatably couple the second pivot member with the lower hinge support.

10. The appliance of claim 9, wherein the support pin receptacle is at least partially defined by an interior linear edge of the lower hinge support.

11. The appliance of claim 10, wherein the lower hinge pin includes a central portion having a linear side and extending from a body, and further wherein the central portion is received by the support pin receptacle and the linear side is in contact with the interior linear edge of the lower hinge support to couple the lower hinge pin to rotate with the lower hinge support.

12. The appliance of claim 11, wherein the body is received by and vertically translatable through the first pin receptacle.

13. The appliance of claim 9, wherein the lower hinge mount is operably coupled with a foot that extends from a bottom panel of the appliance body.

14. The appliance of claim 9, wherein the first and second positions of the second pivot member correspond with closed and open positions of the door, respectively.

15. A lower hinge assembly for an appliance door, comprising:

a lower pivot member coupled with a hinge mount and defining a first pin receptacle, the lower pivot member including a lower protrusion;

an upper pivot member defining a second pin receptacle aligned with the first pin receptacle and including an upper protrusion;

a lower hinge pin extending through the first and second pin receptacles and coupled to rotate in conjunction with the upper pivot member, wherein the lower hinge pin is vertically translated within the first pin receptacle when the upper pivot member moves from a first position to a second position; and a lower hinge support including a stop monolithic with the lower hinge support, the stop extending toward the upper pivot member, wherein the stop is received within a receiving space defined by the upper pivot member to non-rotatably couple the upper pivot member with the lower hinge support.

16. The lower hinge assembly of claim 15, wherein the hinge mount is operably coupled with a foot.

17. The lower hinge assembly of claim 15, wherein the lower pivot member defines a receiving well and the upper protrusion of the upper pivot member is received by the receiving well in the second position.

18. The lower hinge assembly of claim 15, wherein the upper pivot member is rotatable between the first and second positions relative to the lower pivot member.

* * * * *